US010059135B2

(12) United States Patent
Ando

(10) Patent No.: US 10,059,135 B2
(45) Date of Patent: Aug. 28, 2018

(54) THERMAL PRINTER AND PORTABLE TERMINAL

(71) Applicant: Seiko Instruments Inc., Chiba-shi, Chiba (JP)

(72) Inventor: Norihisa Ando, Chiba (JP)

(73) Assignee: SEIKO INSTRUMENTS INC., Chiba (JP)

( * ) Notice: Subject to any disclaimer, the term of this patent is extended or adjusted under 35 U.S.C. 154(b) by 0 days.

(21) Appl. No.: 15/586,772

(22) Filed: May 4, 2017

(65) Prior Publication Data

US 2017/0326894 A1 Nov. 16, 2017

(30) Foreign Application Priority Data

May 16, 2016 (JP) ..... 2016-098106

(51) Int. Cl.

| | |
|---|---|
| ***B41J 25/34*** | (2006.01) |
| ***B41J 2/335*** | (2006.01) |
| ***B41J 2/32*** | (2006.01) |
| ***B41J 25/304*** | (2006.01) |
| ***B41J 25/312*** | (2006.01) |
| ***B41J 25/316*** | (2006.01) |

(52) U.S. Cl.

CPC ..... *B41J 25/34* (2013.01); *B41J 2/32* (2013.01); *B41J 2/335* (2013.01); *B41J 25/304* (2013.01); *B41J 25/312* (2013.01); *B41J 25/316* (2013.01); *B41J 2202/31* (2013.01)

(58) Field of Classification Search

CPC ..... B41J 2/32; B41J 3/4075; B41J 11/04

See application file for complete search history.

(56) References Cited

U.S. PATENT DOCUMENTS 4,617,577 A * 10/1986 Takahashi ..... B41J 2/325 346/105

5,117,241 A * 5/1992 Stephenson ..... B41J 17/02 347/214

(Continued)

FOREIGN PATENT DOCUMENTS

| | | | |
|---|---|---|---|
| EP | 0 794 066 | A1 | 9/1997 |
| EP | 1 602 502 | A1 | 12/2005 |
| JP | 2015-044353 | A | 3/2015 |

OTHER PUBLICATIONS

Extended European Search Report in corresponding European Application No. 1717325.8, dated Oct. 11, 2017, 7 pages.

*Primary Examiner* — John P Zimmermann

(74) *Attorney, Agent, or Firm* — Brinks Gilson & Lione

(57) ABSTRACT

A thermal printer includes a platen roller, a thermal head, a head support plate, a frame including a platen roller support portion, a turn support portion configured to support the head support plate, and an urging member configured to urge the head support plate in a direction in which the thermal head approaches the platen roller. The thermal head is fixed to an opposed surface of the head support plate, which is in a first region located on one side with respect to the turn support portion, and is opposed to the platen roller in the first direction. The urging member is interposed between the opposed surface of the head support plate in a second region, which is located on another side with respect to the turn support portion and an urging member support portion of the frame.

14 Claims, 7 Drawing Sheets

(56) References Cited

U.S. PATENT DOCUMENTS

| | | | | |
|---|---|---|---|---|
| 5,709,488 | A * | 1/1998 | Imai | B41J 17/24 347/216 |
| 6,017,159 | A * | 1/2000 | Tse | B41J 25/316 347/196 |
| 6,183,148 | B1 | 2/2001 | Martinez et al. | |
| 8,104,980 | B2 * | 1/2012 | Murata | B41J 15/044 400/613 |
| 2009/0290010 | A1 * | 11/2009 | Nureki | B41J 2/32 347/220 |
| 2010/0045764 | A1 | 2/2010 | Abe et al. | |
| 2015/0062280 | A1 | 3/2015 | Takabatake et al. | |
| 2016/0185141 | A1 * | 6/2016 | Murata | B41J 2/32 347/104 |

* cited by examiner

THERMAL PRINTER AND PORTABLE TERMINAL

RELATED APPLICATIONS

This application claims priority under 35 U.S.C. § 119 to Japanese Patent Application No. 2016-098106 filed on May 16, 2016, the entire content of which is hereby incorporated by reference.

BACKGROUND OF THE INVENTION

1. Field of the Invention

The present invention relates to a thermal printer and a portable terminal.

2. Description of the Related Art

Hitherto, a thermal printer has been known as a printer configured to perform printing on a recording sheet (heat-sensitive paper). The thermal printer includes a thermal head, a platen roller, and a frame. The thermal head includes a heating element. The platen roller is configured to feed the recording paper by nipping the recording paper with the thermal head. The frame is configured to support the platen roller and the thermal head. In the thermal printer, the heating element of the thermal head is caused to generate heat as appropriate during a course of feeding the recording paper through rotation of the platen roller, thereby being capable of printing various information on the recording paper.

The above-mentioned thermal head is supported on the frame so as to be turnable under a state of being fixed to a head support plate. An urging member configured to urge the thermal head against the platen roller is interposed between the frame and the head support plate. With this, the thermal head is pressed against an outer peripheral surface of the platen roller.

Incidentally, particularly for a thermal printer which is to be mounted to a portable terminal such as a card payment terminal, downsizing in a thickness direction, that is, in a direction in which the thermal head approaches and separates from the platen roller has been demanded. In order to downsize the thermal printer in the thickness direction, it is conceivable to reduce a space for a head back surface region, that is, a region between a back surface of the head support plate and the frame.

However, for a related-art thermal printer, there is a limit in downsizing the thermal printer in the thickness direction while securely pressing the thermal head against the platen roller. Therefore, for the thermal printer of this type, downsizing in the thickness direction has been demanded.

SUMMARY OF THE INVENTION

According to one embodiment of the present invention, there is provided a thermal printer, including a platen roller, a thermal head arranged so as to oppose to the platen roller, a head support plate configured to hold and fix the thermal head, a frame including a roller support portion configured to support the platen roller so as to be rotatable about a first direction, a turn support portion configured to support the head support plate so as to be turnable about the first direction, and an urging member configured to urge the head support plate in a direction in which the thermal head approaches the platen roller about the first direction. The head support plate extends in a second direction intersecting the first direction. The thermal head is fixed to an opposed surface of the head support plate, which is in a first region located on one side in the second direction with respect to the turn support portion, and is opposed to the platen roller in the first direction. The urging member is interposed between the opposed surface of the head support plate in a second region, which is located on another side in the second direction with respect to the turn support portion and an urging member support portion of the frame, which is opposed to the opposed surface in a third direction intersecting the second direction as viewed from the first direction.

In the above-mentioned thermal printer according to the one embodiment of the present invention, wherein the head support plate is bent in a direction which an urged portion side of the head support plate separates from the urging member support portion in the third direction.

In the above-mentioned thermal printer according to the one embodiment of the present invention, wherein the urging member comprises a cylindrical coil spring having an axial direction in the third direction.

In the above-mentioned thermal printer according to the one embodiment of the present invention, herein the turn support portion comprises a shaft that extends in the first direction and is supported on the frame, and wherein the head support plate is turnably supported on the frame through intermediation of the turn support portion.

In the above-mentioned thermal printer according to the one embodiment of the present invention, wherein the turn support portion is integrally formed with the frame and protrudes toward the head support plate from a portion of the frame, which is located on a side opposite to the urging member support portion in the third direction with respect to the head support plate.

In the above-mentioned thermal printer according to the one embodiment of the present invention, wherein the head support plate and the frame have a regulation portion configured to regulate movement of the head support plate in the second direction with respect to the frame.

According to one embodiment of the present invention, there is provided a portable terminal, including the above-mentioned thermal printer, and a casing to which the thermal printer is mounted.

DETAILED DESCRIPTION OF THE PREFERRED EMBODIMENTS

Figure 1:
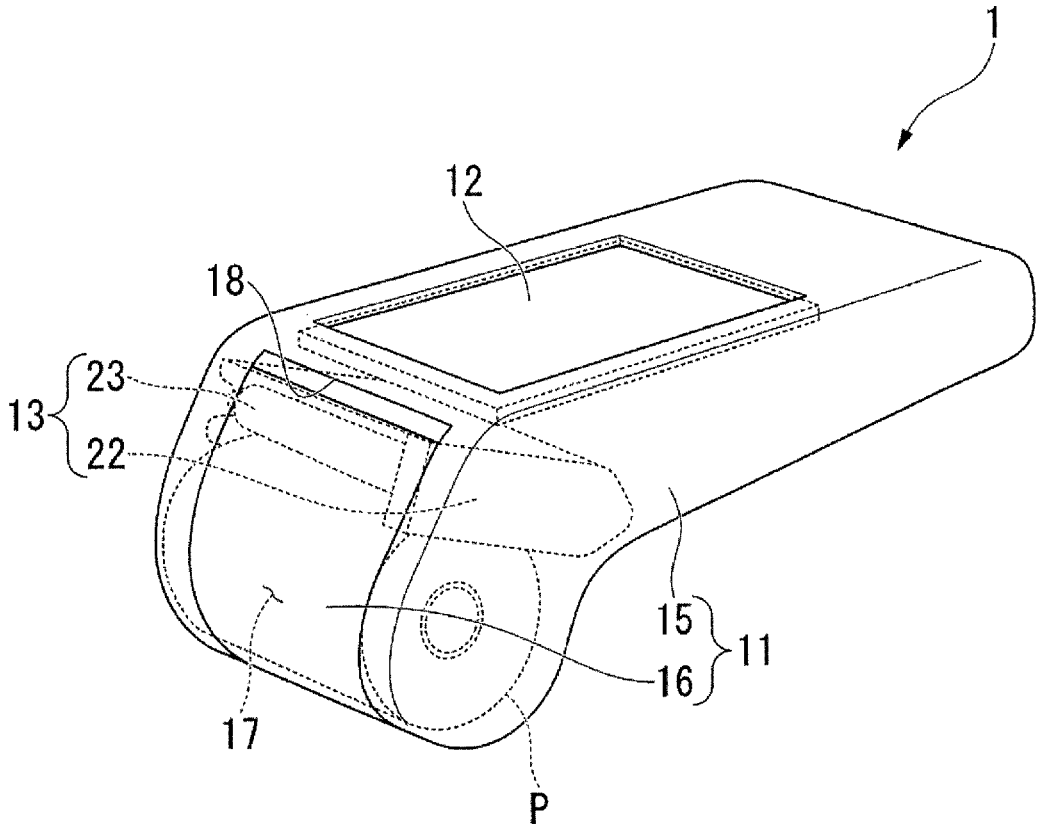
FIG. 1 is a perspective view of a portable terminal according to one embodiment of the present invention.

Now, embodiments of the present invention are described with reference to the accompanying drawings. FIG. 1 is a perspective view of a portable terminal 1. As illustrated in FIG. 1, the portable terminal 1 is, for example, a payment terminal which is portable by a user. The portable terminal 1 includes a casing 11, an input display portion 12, and a thermal printer 13.

The casing 11 includes a casing main body 15 and a printer cover 16. The casing main body 15 is formed into a box shape having a rectangular shape in plan view. In a distal end portion of the casing main body 15, there is formed a recording paper receiving portion 17 configured to receive recording paper P (heat-sensitive paper). The recording paper P is received, under a state of being wound into a roll, in the recording paper receiving portion 17. The printer cover 16 is turnably connected to the casing main body 15 through intermediation of a hinge portion (not shown). The printer cover 16 is configured to open and close the recording paper receiving portion 17. In the casing 11, there is formed a discharge port 18, which is configured to discharge the recording paper P to the outside, between an opening edge of the recording paper receiving portion 17 and a distal edge of the printer cover 16. The input display portion 12 is arranged on a front surface of the casing 11. The input display portion 12 is, for example, a touch panel. The input display portion 12 is configured to display various information on a screen and enable operation to the information displayed on the screen.

The thermal printer 13 is mounted at a position adjacent to the discharge port 18 in the casing 11. The thermal printer 13 is configured to print information with respect to the recording paper P, which is fed from the recording paper receiving portion 17, and to discharge the recording paper P through the discharge port 18.

Figure 2:
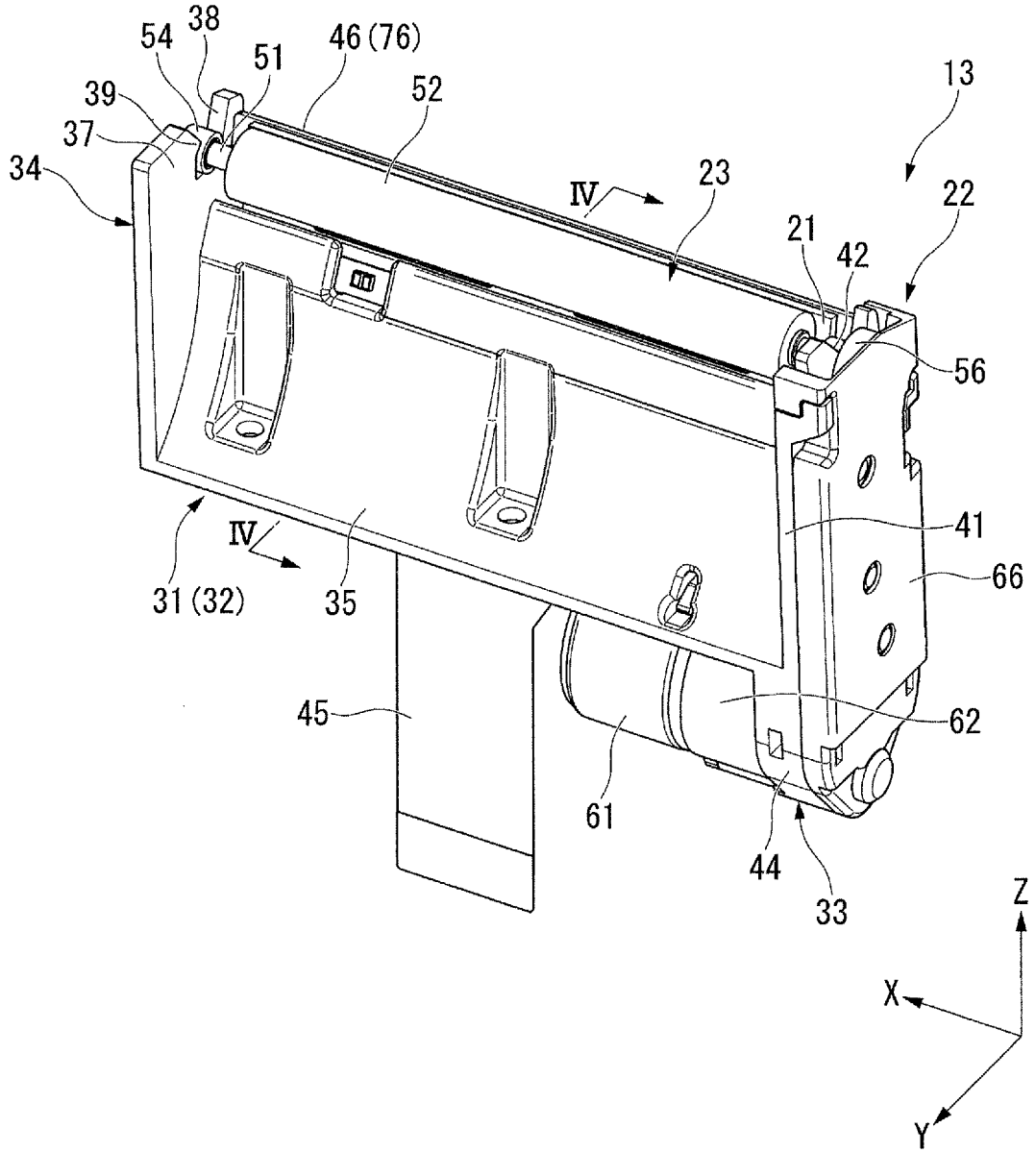
FIG. 2 is a perspective view of a thermal printer according to a first embodiment of the present invention.
Figure 3:
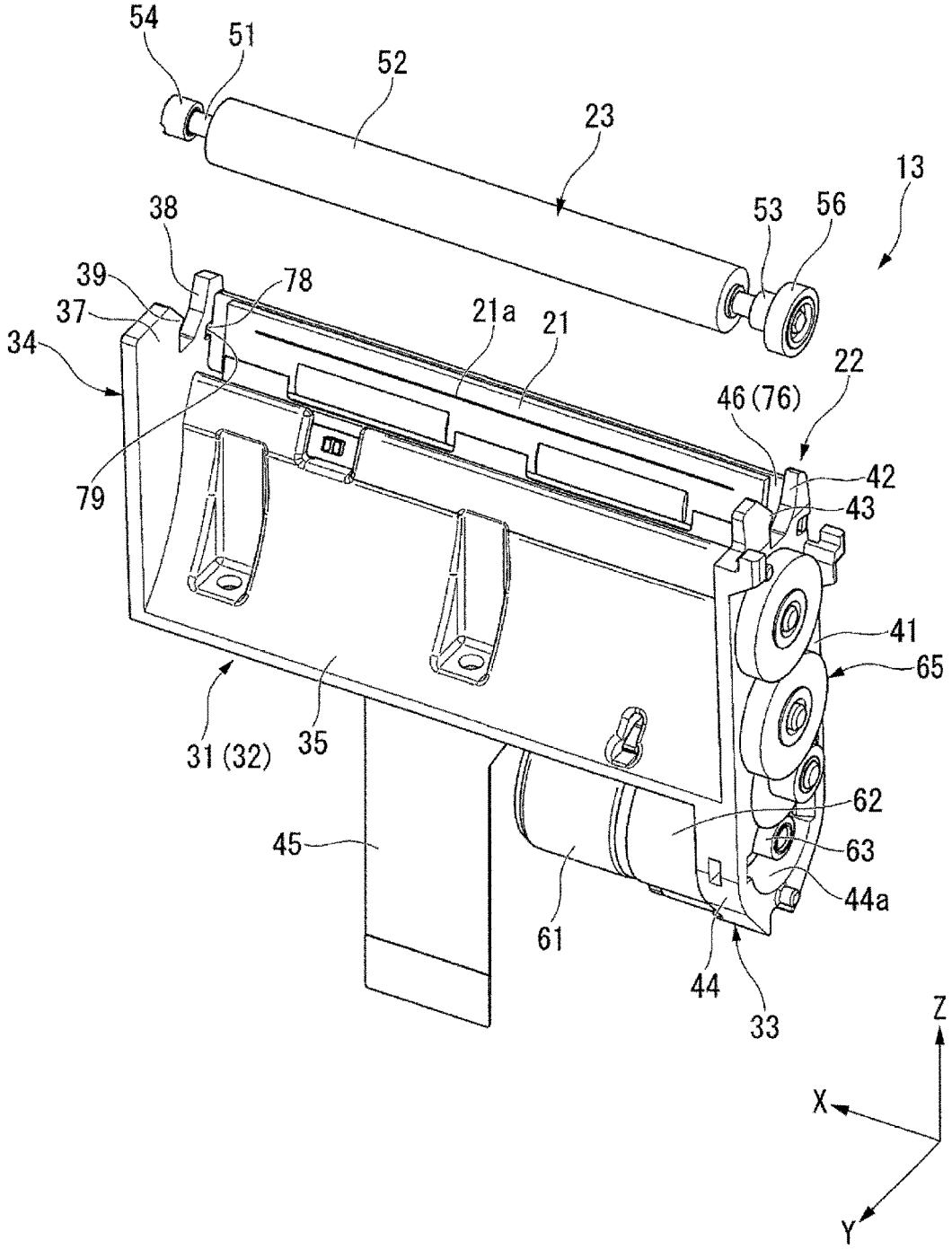
FIG. 3 is an exploded perspective view of the thermal printer according to the first embodiment.

FIG. 2 is a perspective view of the thermal printer 13. FIG. 3 is an exploded perspective view of the thermal printer 13. As illustrated in FIG. 2 and FIG. 3, the thermal printer 13 includes a head unit 22 and a platen roller 23. The head unit 22 includes a thermal head 21. In the example illustrated in FIG. 1, the head unit 22 is assembled to the casing main body 15. The platen roller 23 is assembled to the printer cover 16 and is rotatably supported on the printer cover 16. The printer cover 16 has a shaft in the lower part of FIG. 1, and is opened by left-front side of FIG. 1. At that time, the platen roller 23 moves with the printer cover 16. Thereby, the platen roller 23 and the thermal head 21 (the part of head unit 22) are removed, and the recording paper becomes in a free state. Conversely, when the printer cover 16 is closed, the platen roller 23 follows with the printer cover 16. At that time, the platen roller 23 is located at the position contact with the thermal head 21. In this way, the head unit 22 and the platen roller 23 are combined so as to be separable along with opening and closing of the printer cover 16. When the printer cover 16 takes a closed position, the head unit 22 and the platen roller 23 are opposed to each other across the above-mentioned discharge port 18. In the following description, an axial direction of the platen roller 23 is described as an X direction (first direction), and two directions orthogonal to the X direction are described as a Y direction (third direction) and a Z direction (second direction). Further, in the following description, in each of the X direction, the Y direction, and the Z direction, a direction indicated by the arrow in the drawings is described as a plus direction, and a direction opposite to the arrow is described as a minus direction.

As illustrated in FIG. 3, a frame 31 of the head unit 22 is formed into a U-shape which is opened in a plus Z direction in front view from the Y direction. Specifically, the frame 31 includes a base portion 32, a first side plate portion 33, and a second side plate portion 34. The base portion 32 extends in the X direction. The first side plate portion 33 and the second side plate portion 34 are connected to both end portions of the base portion 32 in the X direction. The base portion 32 includes a guide wall 35 and a back surface plate 36 (see FIG. 4). The guide wall 35 is located in a plus Y direction of the base portion 32. The back surface plate 36 is located in a minus Y direction with respect to the guide wall 35. A surface of the guide wall 35 which is oriented in the plus Y direction constructs a paper passage surface which is configured to guide the recording paper P in the plus Z direction. The paper passage surface is a curved surface which protrudes in the minus Y direction.

Figure 4:
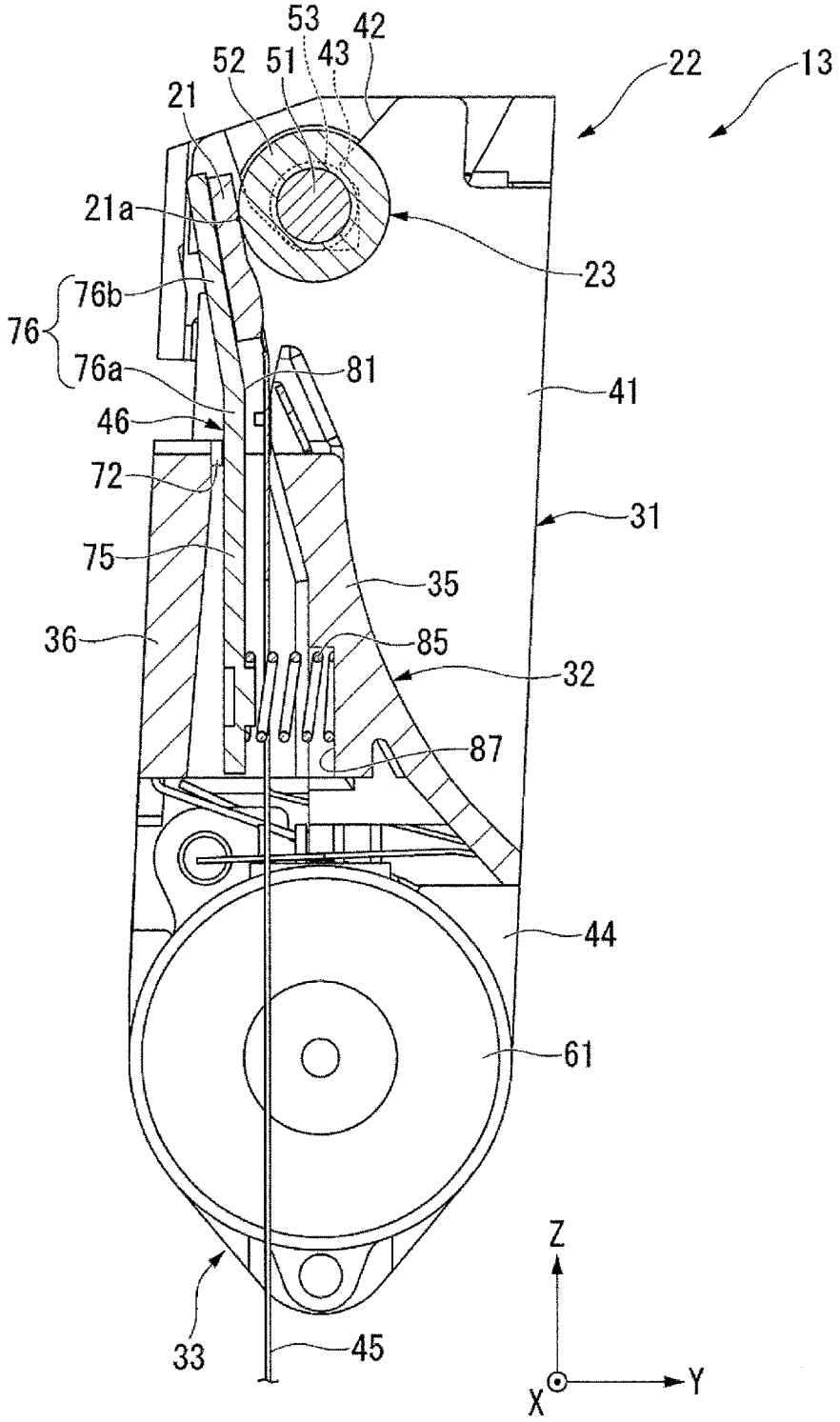
FIG. 4 is a sectional view taken along the line IV-IV of FIG. 2.

FIG. 4 is a sectional view taken along the line IV-IV of FIG. 2. As illustrated in FIG. 4, the back surface plate 36 is arranged so that a center portion thereof in the X direction is opposed to the guide wall 35 at an interval in the Y direction. Meanwhile, both end portions of the back surface plate 36 in the X direction are connected to the guide wall 35.

As illustrated in FIG. 3, first, the second side plate portion 34 is connected to an end portion of the base portion 32, which includes the guide wall 35 and the back surface plate 36, in a plus X direction. A portion of the second side plate portion 34 which protrudes in the plus Z direction with respect to the base portion 32 constructs a second shaft support portion 37. At an end edge of the second shaft support portion 37 in the plus Z direction, there is formed a second roller receiving groove 38 which is recessed in the minus Z direction. At a portion of an inner peripheral edge of the second roller receiving groove 38 which is located in the plus Y direction, there is formed a second hook portion 39 which protrudes in the minus Y direction.

The first side plate portion 33 is connected to the end portion of the base portion 32 in a minus X direction. A portion of the first side plate portion 33 which protrudes in the plus Z direction with respect to the base portion 32 constructs a first shaft support portion 41. At an end edge of the first shaft support portion 41 in the plus Z direction, there is formed a first roller receiving groove (roller support portion) 42 which is recessed in the minus Z direction. At a portion of an inner peripheral edge of the first roller receiving groove 42 which is located in the plus Y direction, there is formed a first hook portion 43 which protrudes in the minus Y direction. A portion of the first side plate portion 33 which protrudes in the minus Z direction with respect to the base portion 32 constructs a motor support portion 44.

The platen roller 23 nips the recording paper P with the thermal head 21 to convey the recording paper P toward the discharge port 18. Specifically, the platen roller 23 includes a platen shaft 51 and a roller main body 52. The platen shaft 51 extends in the X direction. At both end portions of the platen shaft 51 in the X direction, there are mounted a first bearing 53 and a second bearing 54, respectively. The bearings 53 and 54 are retained in the above-mentioned roller receiving grooves 38 and 42, respectively. With this, the platen roller 23 is supported on the shaft support portions 37 and 41 (frame 31) so as to be rotatable about an axis extending in the X direction and so as to be removable from the frame 31. The roller support portions of the shaft support portions 37 and 41, which are configured to rotatably support the platen roller 23, are not limited to the roller receiving grooves 38 and 42. At a portion of the platen shaft 51 which is located in the minus X direction with respect to the first platen shaft 53, there is arranged a driven gear 56. Under a state in which the platen roller 23 is retained in the roller receiving grooves 38 and 42, the driven gear 56 is positioned in the minus X direction from the first shaft support portion 41.

The roller main body 52 is made of, for example, rubber. The roller main body 52 is externally mounted to a portion of the platen shaft 51 other than the both end portions of the platen shaft 51 in the X direction. An outer peripheral surface of the roller main body 52 is held in contact with the above-mentioned thermal head 21.

At a portion of the above-mentioned frame 31 which is located in the plus X direction with respect to the motor support portion 44, there is arranged a motor 61. The motor 61 is arranged under a state in which a rotary shaft (not shown) thereof protrudes in the minus X direction. The motor 61 is connected to the controller through intermediation of a flexible board 45 or the like.

Between the motor 61 and the motor support portion 44 in the X direction, there is arranged a first speed reduction mechanism 62 configured to reduce power of the motor 61. The first speed reduction mechanism 62 is, for example, a planetary gear mechanism. The first speed reduction mechanism 62 has an output gear 63 which protrudes in the minus X direction. The output gear 63 protrudes through a through hole 44*a*, which is formed in the motor support portion 44, in the minus X direction with respect to the motor support portion 44.

At a portion which is located in the minus X direction with respect to the above-mentioned first side plate portion 33, there is arranged a second speed reduction mechanism 65. The second speed reduction mechanism 65 is a gear train mechanism including a two-step gear. The second speed reduction mechanism 65 provides connection between the output gear 63 of the first speed reduction mechanism 62 and a driven gear 56 of the platen roller 23. As illustrated in FIG. 2, the second speed reduction mechanism 65 is covered with a gear cover 66 from the minus X direction.

As illustrated in FIG. 3, the thermal head 21 has a plate-like shape having a thickness direction in the Y direction and extending in the X direction. On an end surface of the thermal head 21 in the plus Y direction, a plurality of heating elements 21*a* are arrayed in the X direction at intervals. The thermal head 21 is connected to a controller (not shown) or the like through intermediation of the flexible board 45. A driver IC (not shown) mounted to the thermal head 21 controls heat generation of the heating elements 21*a* in accordance with a signal from the controller so that the thermal head 21 performs printing with respect to the recording paper P.

As illustrated in FIG. 4, the thermal head 21 is fixed to a head support plate 46 which is arranged on the frame 31 in the minus Y direction with respect to the roller receiving grooves 38 and 42. The head support plate 46 has a plate-like shape having a thickness direction in the Y direction. The head support plate 46 is supported from the minus Y direction by a support protrusion (turn support portion) 72 which protrudes in the plus Y direction from an end portion of the above-mentioned back surface plate 36 in the plus Z direction. With this, the head support plate 46 is turnable at the support protrusion 72 as a support point with respect to the frame 31 about an axis which extends in the X direction.

The head support plate 46 includes an urging portion (second region) 75 and a head mounting portion (first region) 76. The urging portion 75 is located in the minus Z direction with respect to the support protrusion 72. The head mounting portion 76 is located in the plus Z direction with respect to the support protrusion 72. The urging portion 75 is arranged in a gap of the above-mentioned base portion 32 which is formed between the guide wall 35 and the back surface plate 36.

The head mounting portion 76 extends in the plus Z direction from an end edge of the urging portion 75 in the plus Z direction. In the example of FIG. 4, a length of the above-mentioned urging portion 75 in the Z direction is larger than a length of the head mounting portion 76 in the Z direction. The head mounting portion 76 has a bent portion 81 which is bent so as to cause the head mounting portion 76 to protrude in the plus Y direction. The bent portion 81 linearly extends over an entire region of the head support plate 46 in the X direction. Thus, under a state in which the platen roller 23 is mounted, a portion of the head mounting portion 76 which is located in the minus Z direction from the bent portion 81 (hereinafter referred to as "minus Z direction plate portion 76*a*") is linearly connected to the urging portion 75. Meanwhile, a portion of the head mounting portion 76 which is located in the plus Z direction from the bent portion 81 (hereinafter referred to as "plus Z direction plate portion 76*b*") is inclined so as to extend in the minus Y direction toward the plus Z direction.

The bent portion 81 may be formed in the urging portion 75. That is, it is only necessary that the bent portion 81 be bent in a direction in which the urging portion 75 separates from the guide wall 35 in the Y direction as compared to a case where the entire head support plate 46 is formed linearly. However, the entire head support plate 46 may be formed linearly.

The above-mentioned thermal head 21 is fixed to an end surface of the plus Z direction plate portion 76*b* of the head mounting portion 76 in the plus Y direction, that is, to a surface opposed to the platen roller 23. The thermal head 21 is held in press-contact with an outer peripheral surface of the platen roller 23. As illustrated in FIG. 3, at both end portions of the plus Z direction plate portion 76*b* of the head mounting portion 76 in the X direction, there are formed engagement pieces (regulation portions) 78 which protrude in both directions in the X direction. The engagement pieces 78 are individually received in engagement recess portions (regulation portions) 79 formed in the side plate portions 33 and 34. Movement of the engagement pieces 78 in the Z direction is regulated in the engagement recess portions 79. With this, movement of the thermal head 21 in the Z direction with respect to the frame 31 is regulated. It is only necessary that the engagement pieces 78 and the engagement recess portions 79 be configured to regulate movement of the head support plate 46 in the Z direction with respect to the frame 31 within a predetermined range.

As illustrated in FIG. 4, urging members 85 are interposed between an end portion of the urging portion 75 in the minus Z direction and the frame 31. The urging members 85 are cylindrical coil springs each having an axial direction in the Y direction. End portions of the urging members 85 in the minus Y direction are held in abutment against an end surface of the urging portion 75 in the plus Y direction at the end portion of the urging portion 75 in the minus Z direction. Meanwhile, end portions of the urging members 85 in the plus Y direction are held in abutment against an urging member support portion 87, which is formed in the above-mentioned guide wall 35, from the minus Y direction. With this, the urging members 85 urge the urging portion 75 and the urging member support portion 87 in a direction of separating the urging portion 75 and the urging member support portion 87 from each other in the Y direction. That is, the urging members 85 urge the head support plate 46 in a direction in which the thermal head 21 is pressed against the platen roller 23. Not limited to the cylindrical coil springs, there may be used conical coil springs, leaf springs, or the like as the urging member 85.

In the illustrated example, the urging member support portion 87 is a bottom surface of a recess portion which is recessed in the plus Y direction with respect to an end surface of the guide wall 35 in the minus Y direction. However, as long as the urging members 85 can be supported, the configuration of the urging member support portion 87 can be changed as appropriate.

The urging members 85 of a first embodiment of the present invention are arranged at two locations in the X direction at intervals. At a position between the guide wall 35 and the back surface plate 36 of the base portion 32 and between the urging members 85 adjacent to each other in the X direction, the above-mentioned flexible board 45 is drawn in the Z direction. However, the number, layout, and the like of the urging members 85 can be changed as appropriate.

Next, an operation method of the above-mentioned portable terminal 1 is described. In the following description, it is assumed that a leading edge of the recording paper P is nipped between the platen roller 23 and the thermal head 21. In the portable terminal 1, printing with respect to the recording paper P is started through operation to the input display portion 12. Specifically, a signal is output from the controller to the motor 61 through, for example, the flexible board 45, with the result that the motor 61 rotates. The power of the motor 61 is reduced by the first speed reduction mechanism 62 and the second speed reduction mechanism 65 and thereafter is transmitted to the driven gear 56. With this, the platen roller 23 is rotated. Then, the recording paper P nipped between the outer peripheral surface of the platen roller 23 and the thermal head 21 is delivered toward the discharge port 18.

When the signal is output from the controller to the thermal head 21 through the flexible board 45 during the course of delivering the recording paper P through rotation of the platen roller 23, the heating elements 21*a* of the thermal head 21 generate heat as appropriate. With this, various information is printed with respect to the recording paper P. Then, the recording paper P discharged through the discharge port 18 is cut and used as, for example, a receipt.

Figure 5:
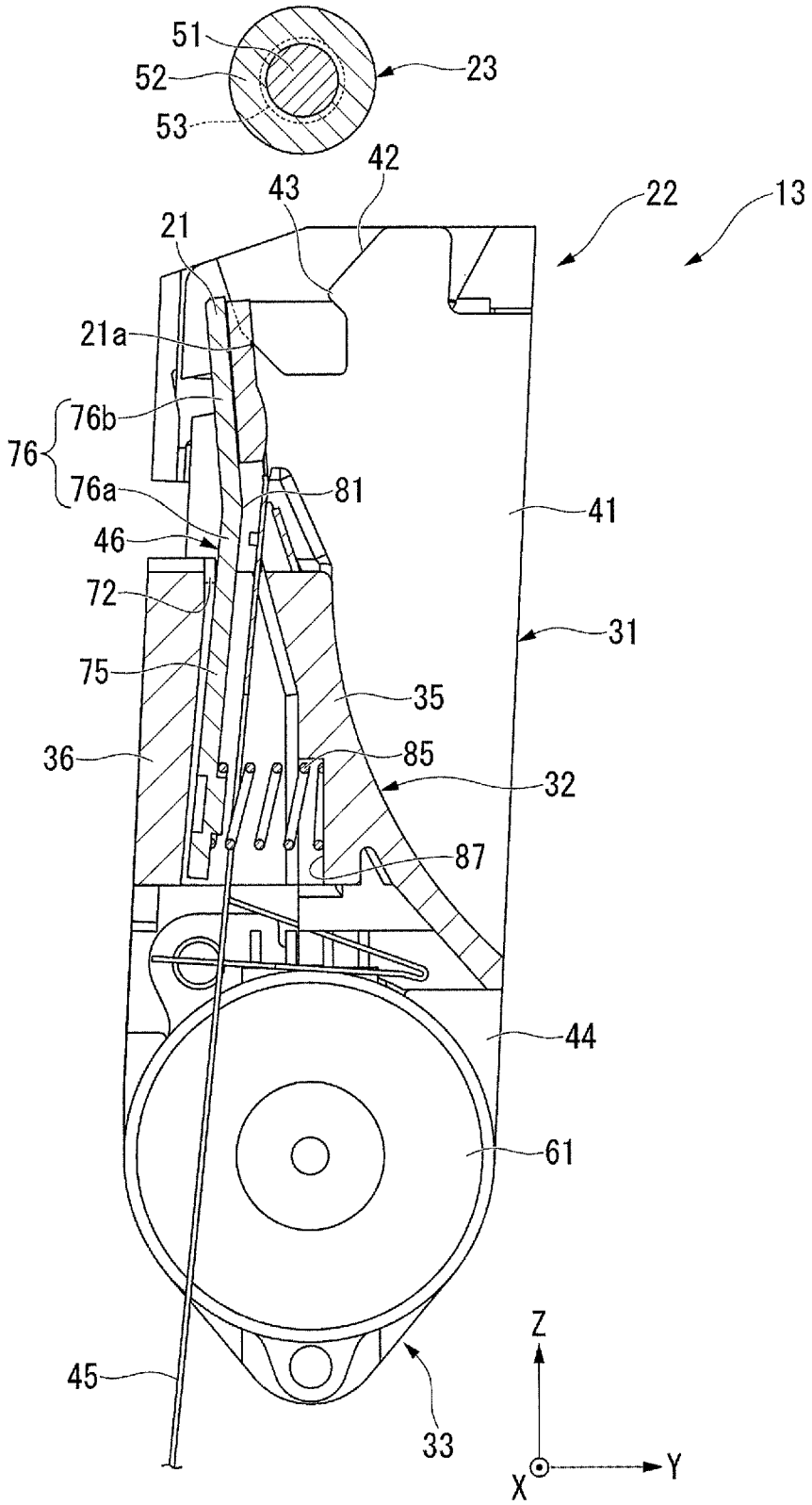
FIG. 5 is an explanatory view for illustrating a mounting and removing operation for a platen roller, and is a sectional view corresponding to FIG. 4.
Figure 6:
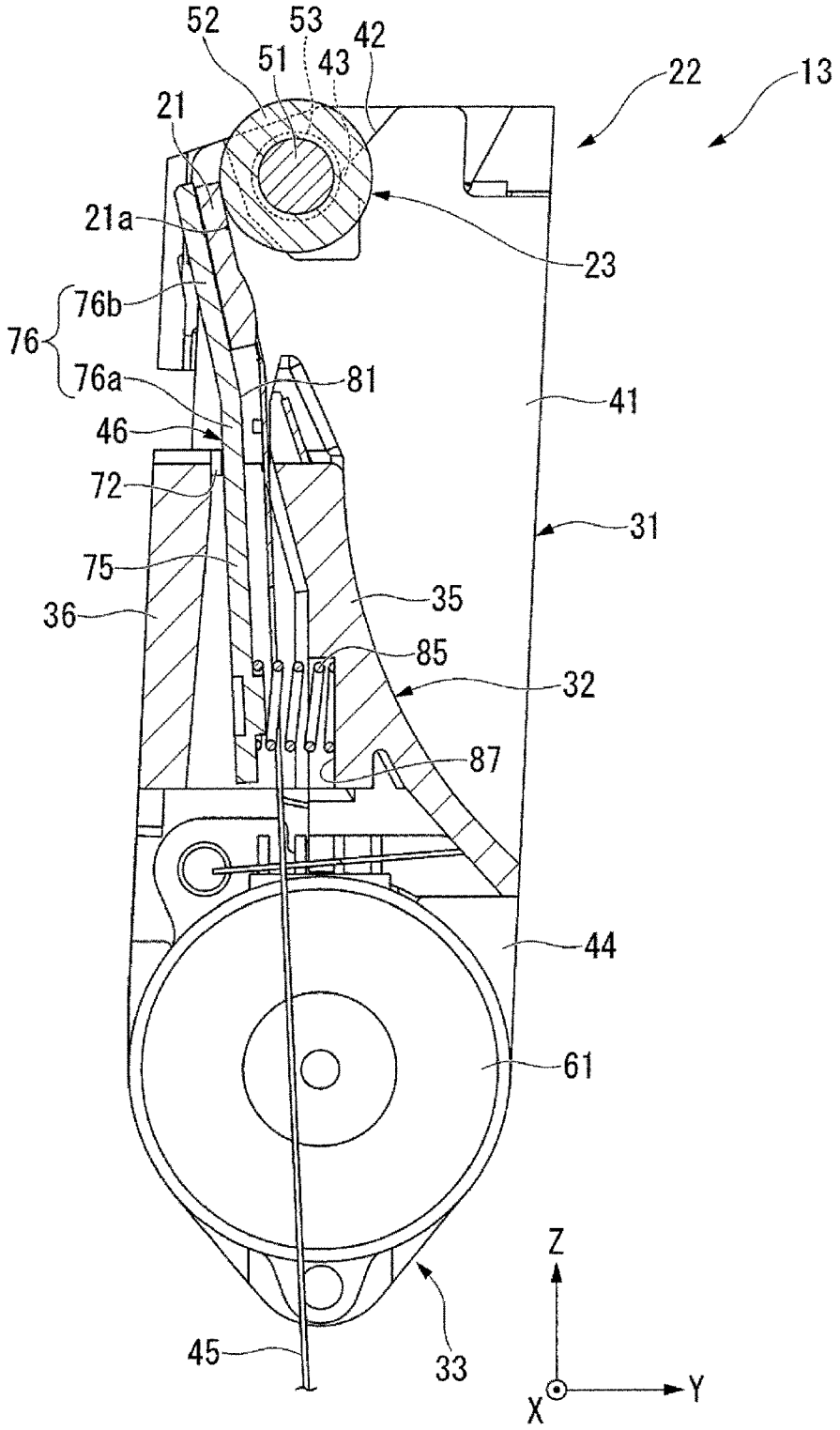
FIG. 6 is an explanatory view for illustrating the mounting and removing operation for the platen roller, and is a sectional view corresponding to FIG. 4.

Next, an action of the thermal printer 13 according to the first embodiment is described. In the following, a closing operation of the printer cover 16 is described as an example of an operation of the head support plate 46. FIG. 5 and FIG. 6 are explanatory views for illustrating a mounting and removing operation for the platen roller 23, and are sectional views corresponding to FIG. 4. As illustrated in FIG. 5 and FIG. 6, during the closing operation of the printer cover 16, a roller main body 52 of the platen roller 23 presses the head support plate 46 in the minus Y direction through intermediation of the thermal head 21. Then, as illustrated in FIG. 6, the head support plate 46 turns, with the contact portion to the support protrusion 72 as a support point, in a direction against the urging force of the urging members 85, that is, in a direction in which the head mounting portion 76 moves in the minus Y direction. With this action, bearings 53 and 54 of the platen roller 23 enter the roller receiving grooves 38 and 42.

Then, as the bearings 53 and 54 of the platen roller 23 goes over top portions of the hook portions 39 and 43, the head support plate 46 turns, with the contact portion to the support protrusion 72 as a support point, in a direction of restoring the urging members 85, that is, in the direction in which the head mounting portion 76 moves in the plus Y direction. With this action, the platen roller 23 is assembled to the head unit 22 under a state in which the thermal head 21 is pressed by the restoring force of the head support plate 46. Thus, the above-mentioned printing operation can be performed under a state in which the recording paper P is reliably sandwiched between the platen roller 23 and the thermal head 21. At the time of an opening operation of the printer cover 16, an operation which is reverse to the above-mentioned operation is performed.

As described above, in the first embodiment, the urging members 85 are interposed between the end surface of the urging portion 75 in the plus Y direction which is located at the head support plate 46 in the minus Z direction with respect to the support protrusion 72 and the urging member support portion 87 of the frame 31 which is opposed to the end surface of the urging portion 75 in the plus Y direction. According to this configuration, the urging members 85 are arranged in the plus Y direction of the head support plate 46, thereby being capable of reducing the head back surface region, that is, the region in the minus Y direction with respect to the head support plate 46 as compared to the related-art configuration in which the urging members 85 are arranged in the minus Y direction of the head support plate 46. With this, the thermal printer 13 can be downsized in the Y direction.

In the first embodiment, the head support plate 46 is bent in the minus Y direction, thereby being capable of increasing a space for arranging the urging members 85 which is formed between the urging member support portion 87 and the head support plate 46 as compared to the case where the head support plate 46 linearly extends. As a result, the urging members 85 having a large urging force can be arranged between the urging member support portion 87 and the head support plate 46. In this case, even when the number of urging members 85 is reduced, a stable urging force can be exerted on the head support plate 46. Therefore, the flexible board 45 can be drawn between the urging members 85 which are adjacent in the X direction, which may result in improvement in space efficiency in the frame 31. Further, the space for arranging the urging members 85 is secured between the urging member support portion 87 and the head support plate 46, thereby being capable of using the cylindrical coil springs as the urging members 85. With this, for example, as compared to the case where conical coil springs are used, more stable load (urging force) can be exerted on the head support plate 46.

In the first embodiment, the head support plate 46 is directly supported so as to be turnable by the support protrusion 72 integrally formed with the frame 31, thereby being capable of reducing the number of parts as compared to the case where a member configured to support turning of the head support plate 46 is provided separately from the frame 31. In the first embodiment, the engagement pieces 78 and the engagement recess portions 79 which are configured to regulate the movement of the head support plate 46 in the Z direction with respect to the frame 31 are provided, thereby being capable of preventing drop of the head support plate 46 from the frame 31 and enabling a stable operation of the head support plate 46.

The portable terminal 1 of the first embodiment includes the above-mentioned thermal printer 13, thereby being capable of providing the portable terminal 1 having a small size.

Figure 7:
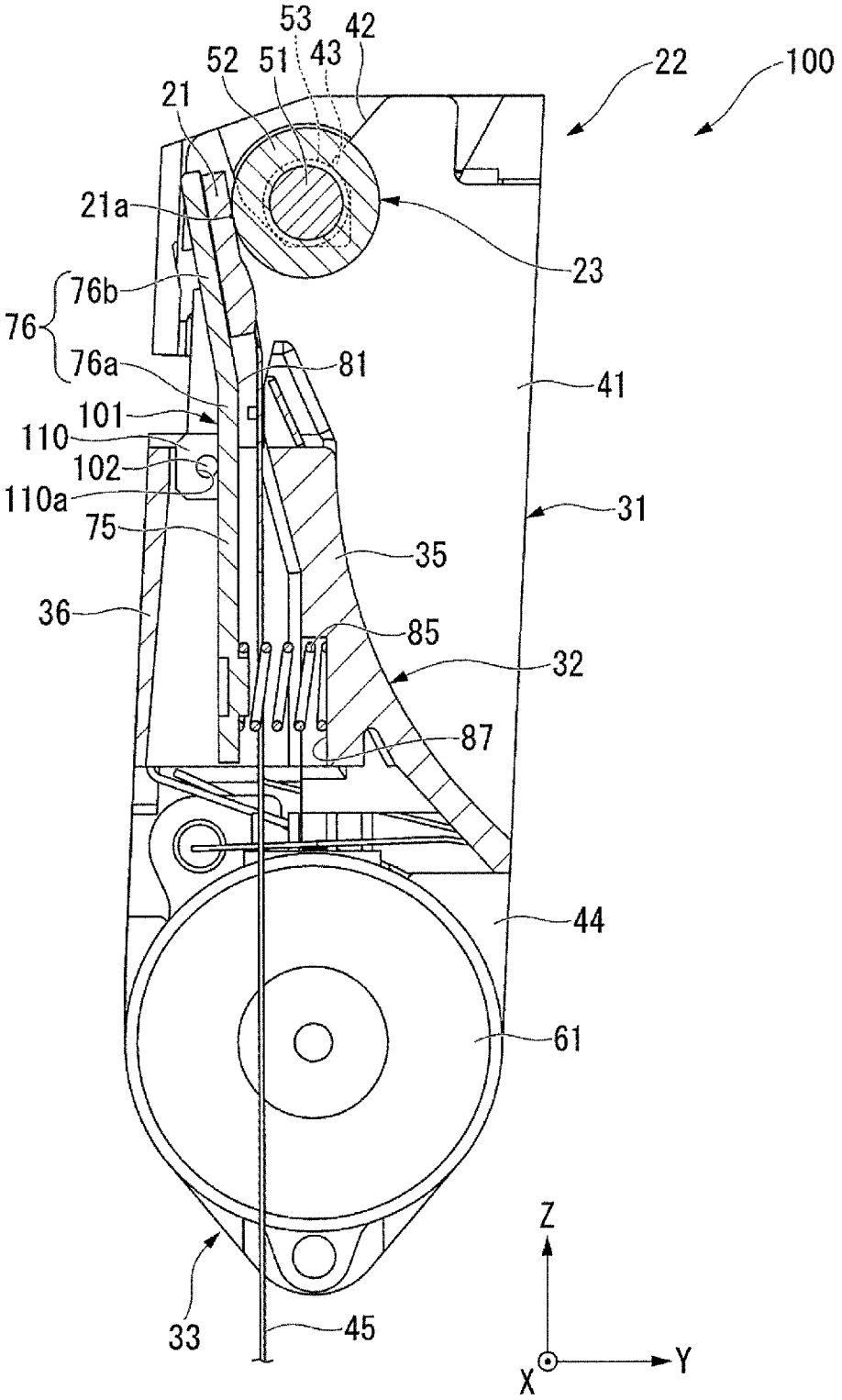
FIG. 7 is a sectional view of a thermal printer according to a second embodiment of the present invention.

Next, a second embodiment of the present invention is described. FIG. 7 is a sectional view of a thermal printer 100 according to the second embodiment. The second embodiment is different from the above-mentioned embodiment in that a head support plate 101 is turnably supported on the frame 31 through intermediation of a shaft (turn support portion) 102. In the following description, components which are the same as those of the above-mentioned embodiment are denoted by the same reference symbols, and description thereof is omitted. In the thermal printer 100 illustrated in FIG. 7, shaft support pieces 110 are formed on both end portions of the head support plate 101 in the X direction. The shaft support pieces 110 protrude in the minus Y direction from a boundary portion of the head support plate 101 between the urging portion 75 and the head mounting portion 76. The shaft support pieces 110 are formed at equivalent positions in the Z direction. Each shaft support piece 110 has a through hole 110*a* which penetrates through the shaft support piece 110 in the X direction.

The shaft 102 is formed into a bar-like shape which extends in the X direction. The shaft 102 is inserted into the through hole 110*a* of each shaft support piece 110. Both end portions of the shaft 102 in the X direction are supported on the above-mentioned shaft support portions 37 and 41 of the frame 31.

In the second embodiment, the actions and effects which are similar to those of the above-mentioned embodiment can be achieved. Further, the urging force of the urging member 85 can be stably exerted on the head support plate 101, thereby being capable of allowing the head support plate 101 to stably turn about the shaft 102.

Note that, the technical scope of the present invention is not limited to the above-mentioned embodiments, but various modifications may be made without departing from the gist of the present invention.

In the above-mentioned embodiments, description is made of the case where the payment terminal is used as one example of the portable terminal 1. However, not limited to this configuration, the configuration of the present invention may be applied to various types of portable terminals.

Besides the above, the components in the above-mentioned embodiments may be replaced by well-known components as appropriate without departing from the gist of the present invention. The above-mentioned modified examples may be combined with each other as appropriate.

What is claimed is:

1. A thermal printer, comprising:

a platen roller;

a thermal head opposite the platen roller;

a head support plate configured to hold and fix the thermal head;

a frame including a roller support portion configured to support the platen roller so as to be rotatable about a first direction;

a turn support portion configured to support the head support plate so as to be turnable about the first direction; and an urging member in contact with an urging member support portion and configured to urge the head support plate in a direction in which the thermal head approaches the platen roller about the first direction, the head support plate extending in a second direction intersecting the first direction, the thermal head being fixed to an opposed surface of the head support plate, which is in a first region located on one side in the second direction with respect to the turn support portion, and is opposed to the platen roller in the first direction, and, wherein the urging member is interposed between the opposed surface of the head support plate in a second region and the urging member support portion, the second region located in the second direction with respect to the turn support portion, the urging member support portion faces the opposed surface of the head support plate, and the turn support portion is located on a side of the head support plate opposite to the opposed surface.

2. A thermal printer according to claim 1, wherein the head support plate is bent in a direction which an urged portion side of the head support plate separates from the urging member support portion in a third direction intersecting the second direction as viewed from the first direction.

3. A thermal printer according to claim 1, wherein the urging member comprises a cylindrical coil spring having an axial direction in a third direction intersecting the second direction as viewed from the first direction.

4. A thermal printer according to claim 3, wherein the turn support portion comprises a shaft that extends in the first direction and is supported on the frame, and wherein the head support plate is turnably supported on the frame through intermediation of the turn support portion.

5. A thermal printer according to claim 4, wherein the head support plate and the frame have a regulation portion configured to regulate movement of the head support plate in the second direction with respect to the frame.

6. A thermal printer according to claim 3, wherein the turn support portion is integrally formed with the frame and protrudes toward the head support plate from a portion of the frame, which is.

7. A thermal printer according to claim 6, wherein the head support plate and the frame have a regulation portion configured to regulate movement of the head support plate in the second direction with respect to the frame.

8. A thermal printer according to claim 2, wherein the urging member comprises a cylindrical coil spring having an axial direction in the third direction.

9. A thermal printer according to claim 1, wherein the turn support portion comprises a shaft that extends in the first direction and is supported on the frame, and wherein the head support plate is turnably supported on the frame through intermediation of the turn support portion.

10. A thermal printer according to claim 1, wherein the turn support portion is integrally formed with the frame and protrudes toward the head support plate from a portion of the frame, which is located on a side opposite to the urging member support portion in a third direction with respect to the head support plate, the third direction intersecting the second direction as viewed from the first direction.

11. A thermal printer according to claim 1, wherein the head support plate and the frame have a regulation portion configured to regulate movement of the head support plate in the second direction with respect to the frame.

12. A portable terminal, comprising:

the thermal printer of claim 1; and a casing to which the thermal printer is mounted.

13. A portable terminal, comprising:

the thermal printer of claim 5; and a casing to which the thermal printer is mounted.

14. A portable terminal, comprising:

the thermal printer of claim 7; and a casing to which the thermal printer is mounted.

* * * * *